United States Patent [19]

Matranga et al.

[11] 4,007,748

[45] Feb. 15, 1977

[54] FINGERNAIL EXTENSION

[75] Inventors: Eve Matranga, West Los Angeles; Yosh Hokama, Torrance, both of Calif.

[73] Assignee: Eve-N-Tips Industries, Gardena, Calif.

[22] Filed: Feb. 13, 1976

[21] Appl. No.: 657,767

Related U.S. Application Data

[63] Continuation of Ser. No. 557,765, March 12, 1975, abandoned.

[52] U.S. Cl. ..... 132/73

[51] Int. Cl.[2] ..... A45D 29/00

[58] Field of Search ..... 132/73; 106/195

[56] References Cited

UNITED STATES PATENTS

| | | | |
|---|---|---|---|
| 2,073,867 | 3/1937 | Feigenbaum | 132/73 |
| 2,688,331 | 9/1954 | Bogoslowsky | 132/73 |
| 3,478,756 | 11/1969 | Sautter et al. | 132/73 |
| 3,502,088 | 3/1970 | Jarby | 132/73 |
| 3,552,401 | 1/1971 | Michaelson | 132/73 |

*Primary Examiner*—G.E. McNeill

*Attorney, Agent, or Firm*—William W. Haefliger

[57] ABSTRACT

An artificial fingernail is formed to have abutting contact with the convex forward edge of a natural fingernail, and to be securely bonded to that edge.

1 Claim, 13 Drawing Figures

FINGERNAIL EXTENSION

This application is a continuation of Ser. No. 557,765 filed March 12, 1975 now abandoned.

BACKGROUND OF THE INVENTION

This invention relates generally to the application and retention of artificial fingernails to natural fingernails; more specifically, it concerns a simple and rapid method of attaching artificial nails characterized by the elimination of many prior problems and disadvantages.

It has been conventional practice to adhesively attach artificial fingernails directly onto the upper exposed surfaces of natural fingernails. This method not only risks damage to the natural nails as through a promotion of fungus growth at the interface between the nails, but it also requires considerable time and effort and often results in an unsightly, cumbersome and/or fake appearance. No way was known to overcome these problems and disadvantages in the simple manner as is now afforded by the present invention.

SUMMARY OF THE INVENTION

It is a major object of the invention to provide a method of attaching an artificial fingernail to a natural fingernail, which involves the following simple steps:

a. providing an artificial fingernail having a generally concave rearward edge forming a recess to receive the generally convex forward edge of the natural fingernail, b. effecting abutting contact of said artificial fingernail rearward edge with said forward edge of the natural fingernail, and c. applying a quick drying liquid adhesive to artificial and natural fingernails at and proximate said respective rearward and forward edges thereof.

As will be seen, the artificial nail typically may have predetermined transverse curvature and is resiliently flexible to enable manual varying of such curvature so as to generally match the transverse curvature of the natural finger nail at the abutting edges and during application of the liquid adhesive.

As a result, the invention enables rapid attachment of the nails without damage to the natural fingernail; adhesive is only applied to the forwardmost extent of the natural nail; the artificial nail may be left attached for as long as desired, and the natural nail may grow naturally without interference; the nail combination looks and feels natural, and does not appear cumbersome or fake; breakage only involves the artificial nail, and the latter may be simply removed as by trimming off with a scissors at the forward end of the natural nail.

Further, if the artificial nail is applied to extend at a level slightly above the top surface of the natural nail, the former may be filed down to a common level with the natural nail, also, if the artificial nail is applied to extend at a level slightly below the top surface of the natural nail, liquid adhesive may be applied to build up the top level of the artificial nail.

It is a further object of the invention to provide an unusually advantageous artificial fingernail which comprises, basically a. a thin plastic sheet element sized to provide a forward extension of the natural fingernail, b. said element having a generally concave rearward edge shaped to abut said convex forward edge of the natural fingernail and to be adhesively bonded thereto.

These and other objects and advantages of the invention, as well as the details of an illustrative embodiment, will be more fully understood from the following description and drawings, in which:

DRAWING DESCRIPTION

Figure 1:
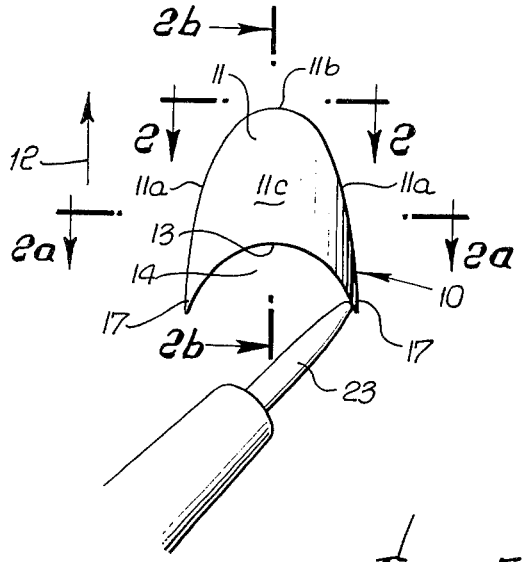
FIG. 1 is a plan view of an artificial nail incorporating the invention.
Figure 2:
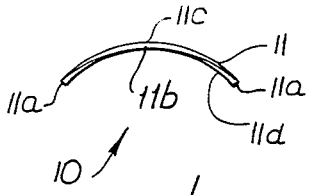
FIG. 2 is an end view of lines 2-2 of FIG. 1.
Figure 2A:
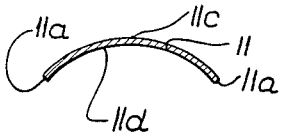
Figure 2B:
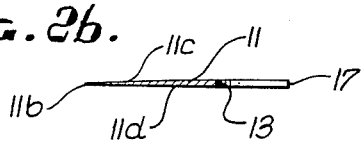
Figure 3:
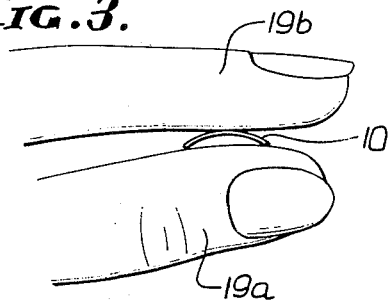
Figure 4:
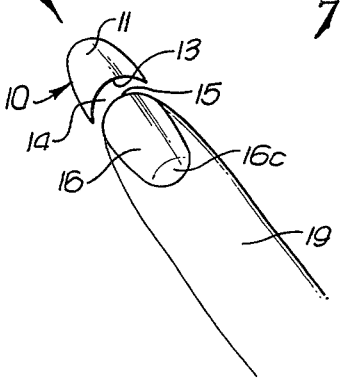
Figure 5:
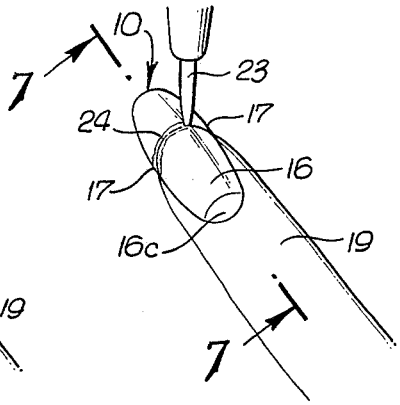
Figure 6:
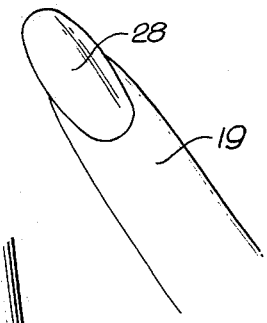
Figure 7:
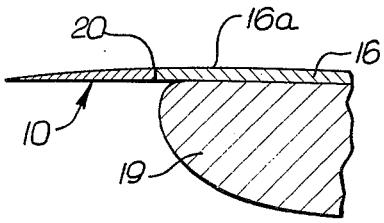
Figure 8:
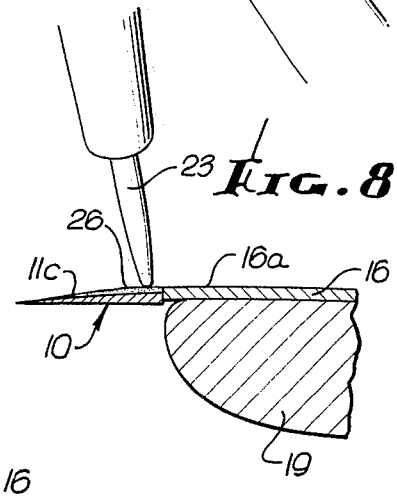
Figure 9:
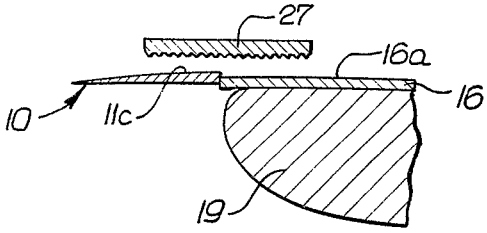
Figure 7A:
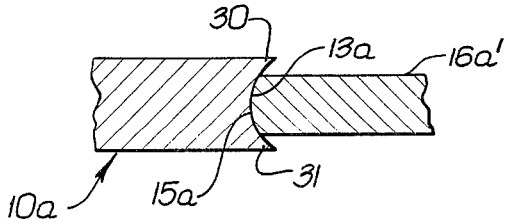
Figure 7B:
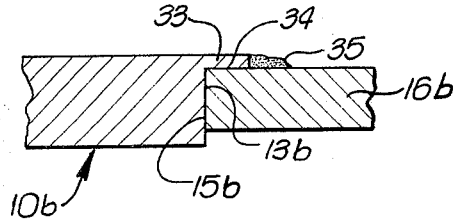

FIG. 2*a* is a section on lines 2*a*—2*a* of FIG. 1;

FIG. 2*b* is a section on lines 2*b*—2*b* of FIG. 1;

FIG. 3 is a view like FIG. 2*a*, showing flattening of the artificial fingernail during application to a natural fingernail;

FIG. 4 is a perspective view showing initial application of the artificial fingernail to a fingernail;

FIG. 5 is a perspective view like FIG. 4, with the artificial fingernail applied to the end of the natural fingernail, and being bonded to same;

FIG. 6 is a view like FIG. 5 but showing the completed dual nail combination;

FIG. 7 is a section on lines 7—7 of FIG. 5;

FIGS. 7*a* and 7*b* are views like FIG. 7 showing modifications;

FIG. 8 is a view like FIG. 7 showing the artificial fingernail applied unevenly below the upper surface level of the natural fingernail; and FIG. 9 is a view like FIG. 7 showing the artificial fingernail applied unevenly above the upper surface level of the natural fingernail.

DETAILED DESCRIPTION

In FIGS. 1–4, an artificial nail 10 in accordance with the invention has a body 11 which is longitudinally elongated and transversely upwardly convex. The opposite sides 11*a* of the nail body tapers forwardly in the direction of arrow 12 and the body is rounded at its forwardmost edge 11*b*. Preferably, but not necessarily, the body convex upper surface 11*c* tapers toward the body concave lower surface 11*d*, as is clear from FIGS. 2 and 2*b*, whereby the forward edge 11*b* is typically sharp.

The body 11 has a generally concave rearward edge 13 forming a recess 14 to receive the generally concave forward edge 15 of a natural (as for example human) fingernail 16, as better seen in FIG. 4. Accordingly, the body 11 forms two laterally spaced, rearwardly projecting cusps 17 at the points or locations where the lateral sides 11*a* meet the lateral extremities of the concave edge 13. The body 11 may consist of an acetate type or other flexible plastic material, and for best results the body maximum thickness lies between about 0.005 and 0.025 inches.

Referring now to the method of attaching the thus provided artificial fingernail 10 to the natural nail 16, an abutting contact is effected between the concave rearward edge 13 with the forward edge 15 of the natural nail. Preliminarily, the natural fingernail 16 may be trimmed as by a scissors to provide and conform blunt edge 15 thereof to the general shape of edge 13; however, an exact match is not required, as direct abutment at only a few edge locations is sufficient. FIG. 7 shows an abutment locus or joint 20, and FIG. 5 shows a close conformance of the edges 13 and 15. The human finger or thumb supporting the natural nail is designated at 19.

Prior to effecting the abutment, a quick drying, liquid adhesive is typically applied to and along edge 13, as by means of the applicator 23 in FIG. 1. During maintenance of the abutment, the same adhesive is typically applied over the joint locus, as at the shaded zone 24 in FIG. 5, i.e. at opposite sides of the joint, and from cusp 17 to cusp 17. After a few seconds, the artificial fingernail is completely and durably secured to the natural fingernail forward blunt edge 15. One unusually advantageous adhesive is that sold under the trademark "CRAZY GLUE", a product of Toagosei Chemical Company, Tokyo, Japan. It is otherwise known as an alpha cyanoacrylate, and is capable of curing or drying in air in about 4–6 seconds.

The natural transverse curvature of the artificial and resilient nail body 11 may be varied to generally match the transverse curvature of the natural nail 16 at the abutting edges 13 and 15, and during curing of the liquid adhesive. FIG. 3 shows the nail body 11 pressed between the thumb and forefinger 19*a* and 19*b* to reduce its curvature, for example, to effect the match, during drying of the adhesive. In this regard, the artificial nail may be molded to have an initial or "set" curvature which is greater than most or all of the natural nails to which it is to be attached, so that the curvature may be easily varied i.e. reduced as by squeezing, to provide the correct abutting match.

FIG. 8 shows the condition wherein a slight mismatch in joinder has resulted in the upper surface extent 11*c* of the artificial nail lying close to but below the upper surface level 16*a* of the natural nail. Quick drying liquid adhesive is then applied to the upper surface 11*c* near the joint to build up surface 11*c* as at 26, the applicator 23 being used for this purpose. FIG. 9 shows the opposite condition, i.e., the attachment carried out to result in surface 11*c* lying above the level of natural nail upper surface 16*a*. In this event, the artificial nail may be filed down, as by means of file 27, to approach the level 16*a*.

Referring back to FIG. 5, it is clear that the adhesive is applied to only the forwardmost extent of the natural nail, so that the "living" portion 16*c* of that nail is not disturbed. FIG. 6 shows the attractive finished nail combination, after a layer of nail polish 28 has been applied to both natural and artificial nails.

The invention also contemplates the combination of an artificial nail which not only abuts the edge of the natural nail, but also slightly overlaps or underlaps the upper or lower end surface of the natural nail. One example of this is seen in FIG. 7*a* wherein the rearward edge 13*a* of artificial nail 10*a* is concavely recessed in a vertical plane to receive the forward edge 15*a* of the natural nail 16*a'*. Edge 15*a* is convex in a vertical plane and is overlapped and underlapped by overhanging extents or cusps 30 and 31 of the artificial nail. Nail 10*a* is thicker than nail 16*a* at the interengagement locus. The nails 10*a* and 16*a'* also may have the curvatures as described above in FIG. 4. The modification of FIG. 7*b* is somewhat like FIG. 7*a*, in that the artificial nail 10*b* "receives" the natural nail 16*b*. In this case, the artificial nail has a ledge 33 which overlaps and is bonded to the surface 34 of the natural nail. Filler glue or cement is shown at 35. The rearward edge 13*b* of the artificial nail abuts and is bonded to the forward edge 15*b* of the natural nail, and these edges may be straight or curved in a vertical plane as well as curved as shown by edges 13 and 15 in FIG. 4.

We claim:

1. In combination with a natural fingernail, a solid artificial fingernail attached to said natural fingernail having a forward-most generally convex peripheral edge, said artificial fingernail comprising a. a thin plastic sheet element sized to provide a forward extension of the natural fingernail, b. said element having a generally concave rearward-most peripheral edge peripherally abutting in edge-to-edge relation the major extent of said convex forward-most edge of the natural fingernail and adhesively bonded thereto only at said edges, the element rearward-most edge contacting the fingernail only at said forward-most edge thereof.

* * * * *